US007374502B2

(12) United States Patent
Comello, Jr.

(10) Patent No.: US 7,374,502 B2
(45) Date of Patent: May 20, 2008

(54) PITCHING TRAINING METHOD AND DEVICE

(76) Inventor: Carlo J. Comello, Jr., 36 Dunbar St., Staten Island, NY (US) 10308

( * ) Notice: Subject to any disclaimer, the term of this patent is extended or adjusted under 35 U.S.C. 154(b) by 0 days.

(21) Appl. No.: 11/584,317

(22) Filed: Oct. 20, 2006

(65) Prior Publication Data

US 2008/0096696 A1 Apr. 24, 2008

(51) Int. Cl.
*A63B 69/00* (2006.01)

(52) U.S. Cl. ..... 473/458; 473/422; 473/450

(58) Field of Classification Search ..... 473/458, 473/450, 464, 422
See application file for complete search history.

(56) References Cited

U.S. PATENT DOCUMENTS 1,826,221 A 10/1931 Pearson
5,250,016 A 10/1993 Higgins
5,938,547 A * 8/1999 Gilford ..... 473/450
6,213,921 B1 * 4/2001 Frey ..... 482/105
6,368,241 B1 4/2002 Abel
6,884,187 B2 4/2005 Cataldi, Jr. et al.

* cited by examiner

*Primary Examiner*—Mitra Aryanpour
(74) *Attorney, Agent, or Firm*—Mary A. Whiting, Esq.

(57) ABSTRACT

A device for learning pitching technique for ball games and improving muscle strength through resistance training. The device, which consists of an elongated U shaped coiled tubular spring with a curved end and pair of straight parallel shaft portions with solid tips, is aligned with and strapped to the user's pitching forearm. The device adjusts to fit the forearm. A rod or elastic string is fitted through a sleeve in the ball's internal polar tunnel, and the opposing ends of the rod or string are attached to the tips so that the ball can be spun around the rod or bounced on the string, to simulate pitching. A shock absorbent casing on the curved end and strap increases comfort. Opposing ends of an elastic band can be attached to the device and a stable object, such as a pole, to perform resistance training.

11 Claims, 8 Drawing Sheets

PITCHING TRAINING METHOD AND DEVICE

FIELD OF THE INVENTION

The invention relates to the field of pitching training devices for use in sports such as baseball and softball, with a dual purpose for teaching proper technique, while also strengthening muscles through resistance training.

BACK GROUND OF THE INVENTION

Games in which a player pitches a ball, such as baseball and softball, are popular with both children and adults. Training devices are useful for beginners, such as children, who want to learn the basics of proper pitching technique, as well for experienced players, such as teenagers or adults, who want to improve their skills.

It is important to accurately simulate the freedom of movement necessary for training proper pitching technique. Therefore, a device which is attached to the user's pitching forearm, which allows for freedom of movement of the forearm, wrist, hand, and fingers without interfering with the movements of the rest of the user's body during the act of pitching, (such as head, neck, shoulders, torso, and legs), is critical to simulate pitching.

Resistance training devices are also useful, since strengthened muscles improves the player's stamina and allows for longer playing time. Also, strong muscles decreases the potential for injury. When a player is injured, they may not be able to continue playing the game. This is not only a disappointment for the player, but the team may suffer by losing its competitive advantage.

Therefore, there is a need for an apparatus which would teach both children and adults of both genders proper technique, through simulation, to increase the accuracy and consistency of pitches, as well as to strengthen muscles through resistance training in order to increase stamina, reduce muscle fatigue, and risk of injury.

To simulate the freedom of movement necessary for learning pitching technique, the present invention, which is a flexible device with an elongated U shaped coiled tubular structure, to which a sphere (such as baseball or softball), is attached to a rod or elastic string which fits into the ball, best accomplishes this goal.

Another sought after goal is to simulate the different styles of pitches, such as straight ball, curve ball, fast ball, change up, slider, and knuckle ball, among others. The present invention effectively simulates these various pitches and gauges the ball's speed, by placing torque (spin) on the ball, so when the ball is released from the user's grip it either spins and moves from side to side on the rod, or bounces in all directions on the elastic string.

It would be also be preferred to have a device which teaches pitching as well as doubles as a strength training device. The present invention successfully accomplishes both goals. To strengthen muscles through resistance training, an elastic band can be attached to the present invention on one end, and then to a stable object, such as a pole or fence, on the other end. While simulating pitching, when the user's pitching forearm is fully extended in front of the user, the elastic band is stretched to create maximum resistance, thus exercising the user's muscles.

SUMMARY OF THE INVENTION

A device, as recited in the claims, is provided which is useful in teaching both children and adults proper pitching technique for ball games, such as baseball or softball, to increase the accuracy and consistency of pitches. The device is also useful to strengthen muscles through resistance training in order to increase stamina, reduce muscle fatigue, and risk of injury.

The present device consists of a flexible elongated U shaped tubular coiled structure, with a pair of parallel straight shaft portions with solid tips, and a curved end portion. The device accommodates a ball with an internal polar tunnel strung on an elastic string or a rod. The internal polar tunnel of the ball may be lined with a sleeve. The opposing ends of the elastic string or rod are attached to the solid tips of the device by common attachment means.

When the ball is attached to an elastic string, at the moment when the ball is released from the fingers' grip, the ball bounces in all directions on the elastic string, following the flexible movements of the wrist, and is retrievable. The ball's movement also indicates the speed of the ball and torque (spin) placed upon the ball, to simulate pitching.

When the ball is attached to a rod, at the moment when the ball is released from the fingers' grip, the ball spins around the rod, and moves from side to side, which indicates the speed of the ball and torque (spin) placed upon the ball, to simulate pitching.

Whether the ball is attached to either elastic string or rod, on each side of the ball spaced slightly offset from the ends of its tunnel, there may preferably be a stopper which accommodates the elastic string or rod, in order to limit the lateral movement of the ball.

Preferably, in order to properly fit the device (with ball attached), to the pitching forearm, the user slides his/her pitching forearm under a padded strap attached to the pair of straight arm portions until the ball can be gripped by the user's forearm. The padded strap is adjusted to sit comfortably on top of the pitching forearm, to form a reverse sling, so the device is held in place by the tension created between the padded strap and the forearm.

The opposing ends of the strap form sleeves which are parallel to the pair of parallel straight shaft portions. The strap's sleeves can be slid along the length of the parallel straight shaft portions in order for the user to adjust the strap into a comfortable position.

If the user desires to place resistance on its pitching forearm among other muscles used in pitching, to increase strength, an elastic band can be preferably attached to the padded strap on one end, and then to a stable object, such as a pole or fence, on the other end, by common anchoring means, such as a slip loop or clasp, respectively.

At the beginning of the pitch, when the pitching forearm is swung behind the user's shoulder, the elastic band will be collapsed and offers no resistance to the user. When the pitch is followed through, and the pitching forearm is swung in front of the user and is fully extended, the elastic band will be stretched to its capacity to offer maximum resistance, which increases muscle strength.

BRIEF DESCRIPTION OF THE DRAWINGS

FIG. 7A' is a right-sided top cross-sectional view of such alternate attachment.

FIG. 7B' is a right-sided top cross-sectional view of such alternate attachment.

DESCRIPTION OF THE PRIOR ART

Figure 1:
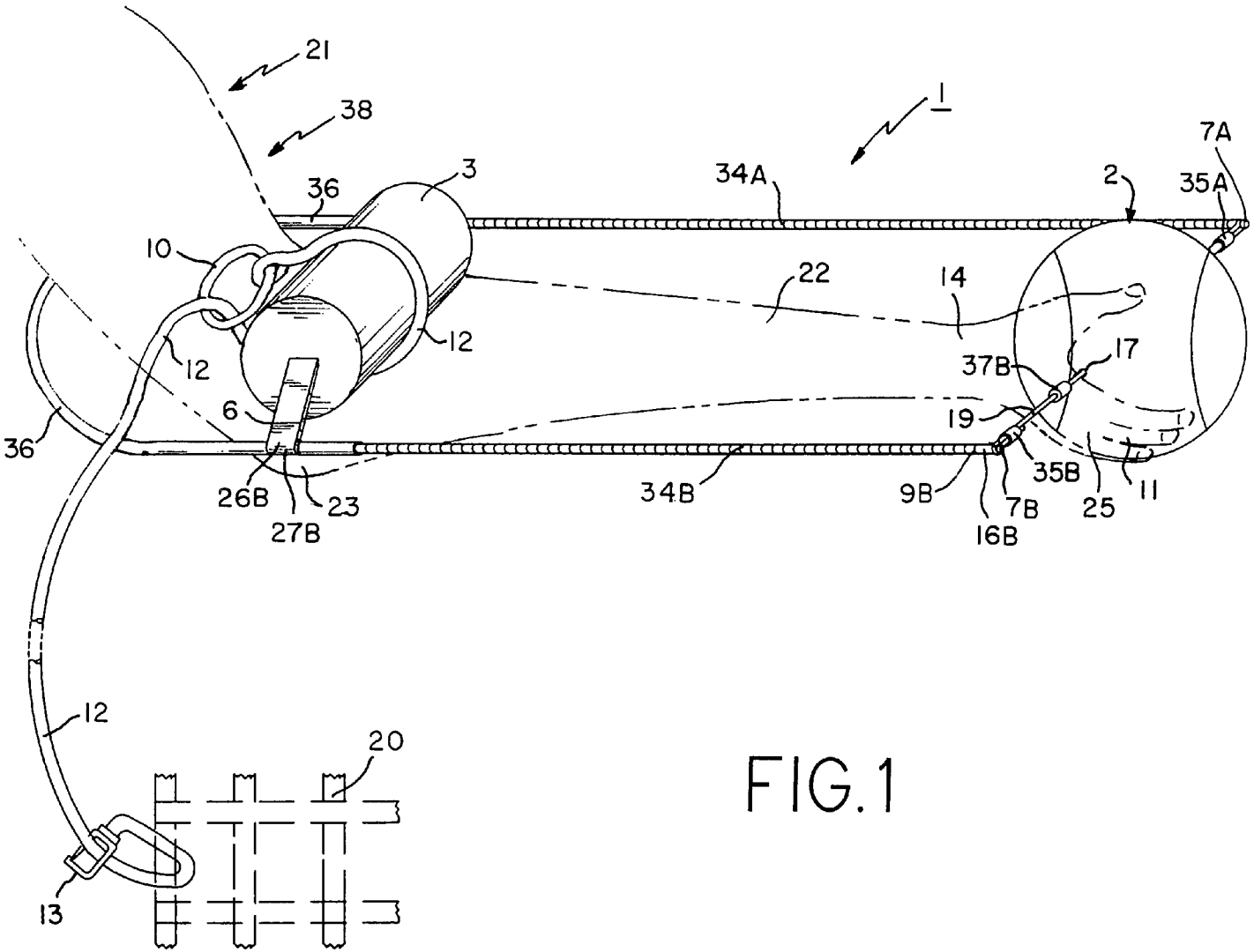
FIG. 1 is a perspective view of the present invention with a ball attached to an elastic string, strapped to a user's pitching forearm in position for throwing an under hand pitch, with an elastic band for resistance training attached to the device's strap and to a fence by common anchoring means.

Over recent years, there have been prior art devices which disclose inventions related to training devices for throwing balls. The present invention can be differentiated from the prior art since the prior art does have the present invention's dual purpose of teaching proper pitching technique for consistency and accuracy, while also strengthening muscles through resistance training in order to increase stamina, reduce muscle fatigue and risk of injury.

There are several patents which disclose devices related to ball games, which can be differentiated from the present invention:

| Inventor | U.S. Pat. No. | Date |
|---|---|---|
| Pearson | 1,826,221 | May 1, 1929 |
| Higgins | 5,250,016 | Oct. 5, 1993 |
| Abel | 6,368,241 | Apr. 9, 2002 |
| Cataldi, Jr., et al. | 6,884,187 B2 | Apr. 26, 2005 |

Prior art includes several device employing a retrievable ball on an elastic band which is attached to the user's wrist, such as Abel's U.S. Pat. No. 6,368,241, dated Apr. 9, 2002, for a wrist toy. The present invention is an improvement over these retrievable ball prior art, since the present invention utilizes the entire arm (arm, forearm, elbow, wrist, hand and fingers) in conjunction with all parts of the user's body (head, neck, shoulder, torso, hips, legs, among others), used for pitching a ball. These retrievable ball prior art only utilize the wrist. The prior art only teaches hand to eye coordination, while the present invention is attached to the user's forearm for freedom of movement to simulate the body's movement during pitching. The prior art can not be used for resistance training, which the present invention can, since the prior art can not be anchored to a stable object. The present invention can be anchored to a stable object.

The structure of the elastic connection between the ball and the user's wrist in the retrievable ball prior art causes the ball to bounce randomly while in use. The present invention has greater control of the ball, since it either spins along a rod, or freely bounces on the elastic string within the user's grasp.

The present invention is an improvement over Cataldi, Jr., et al, U.S. Pat. No. 6,884,187 B2, dated Apr. 26, 2005, for a training device for throwing a ball utilizing elastic resistance forces on the wrist and forearm muscles created by anchoring the device to a stable object, because the present invention is accurately simulates pitching with total freedom of movement by utilizing the entire arm (forearm, elbow, wrist, hand and fingers), in conjunction with other parts of the body used in pitching a ball, without the need to anchor the device to a stable object. Additionally, when the present invention is anchored to a stable object, it delivers the additional advantages absent in Cataldi, Jr., of allowing the ball to spin on a rod, or freely bounce along an elastic string, which creates more realistic simulation of pitching.

The present invention is also an improvement over Higgins, U.S. Pat. No. 5,250,016, dated Oct. 5, 1993, for Baseball throwing Device for Muscle Development Rehabilitation and Training, utilizing a ball on one end, connected to a harness on the opposite end (which harness attaches to a fixed object), by an elastic band, since the present invention is attached to the entire forearm, allowing for complete unencumbered movement and flexibility of not only the user's hand and wrist, but forearm and entire body. Also, the present invention may be attached to a stable object, while still allowing for full unencumbered movement. Also, the present invention's ball not only spins, but moves from side to side to simulate speed of pitching and spin (reverse or forward) placed on the ball, as well as utilizing an elastic string, whereby the ball bounces in all directions, which simulates a curve ball.

The present invention is also an improvement over Peterson, U.S. Pat. No. 1,826,221, dated May 1, 1979, since the hollow ball in Pearson, must be used in conjunction with a stable object, as a tether, or as a push ball. It can not be spun around the rope threaded through it's center, or bounced in various directions in simulate pitching or for resistance training of the forearm, wrist and hand, like the present invention.

OBJECTS AND ADVANTAGES

Accordingly, besides the objects and advantages stated above, several objects and advantages of the present invention are:

To provide for a device which teaches proper pitching techniques for inexperienced users;

To provide for a device which teaches improvement of techniques for experienced users;

To provide for a device which improves the strength of the user's muscles which increases stamina and decreases the risk of injury;

To provide for a device which allows for freedom of movement of the user's arm in conjunction with the rest of the body parts used in pitching, to simulate pitching;

To provide for a device, which allows for resistance training;

To provide for a device which teaches how to place a torque on a ball;

To provide for a device which teaches how to gauge pitching speed;

To provide for a device with a retrievable ball;

To provide for a device for users of all ages and genders;

To provide for a device which accommodates various sized users;

To provide for a device, which is flexible during use, and returns to its original shape when not in use, and To provide for a device which is manufactured out of an inexpensive, flexible, durable, lightweight material, and is easily cleaned.

DETAILED DESCRIPTION OF THE PREFERRED EMBODIMENT

Figure 6:
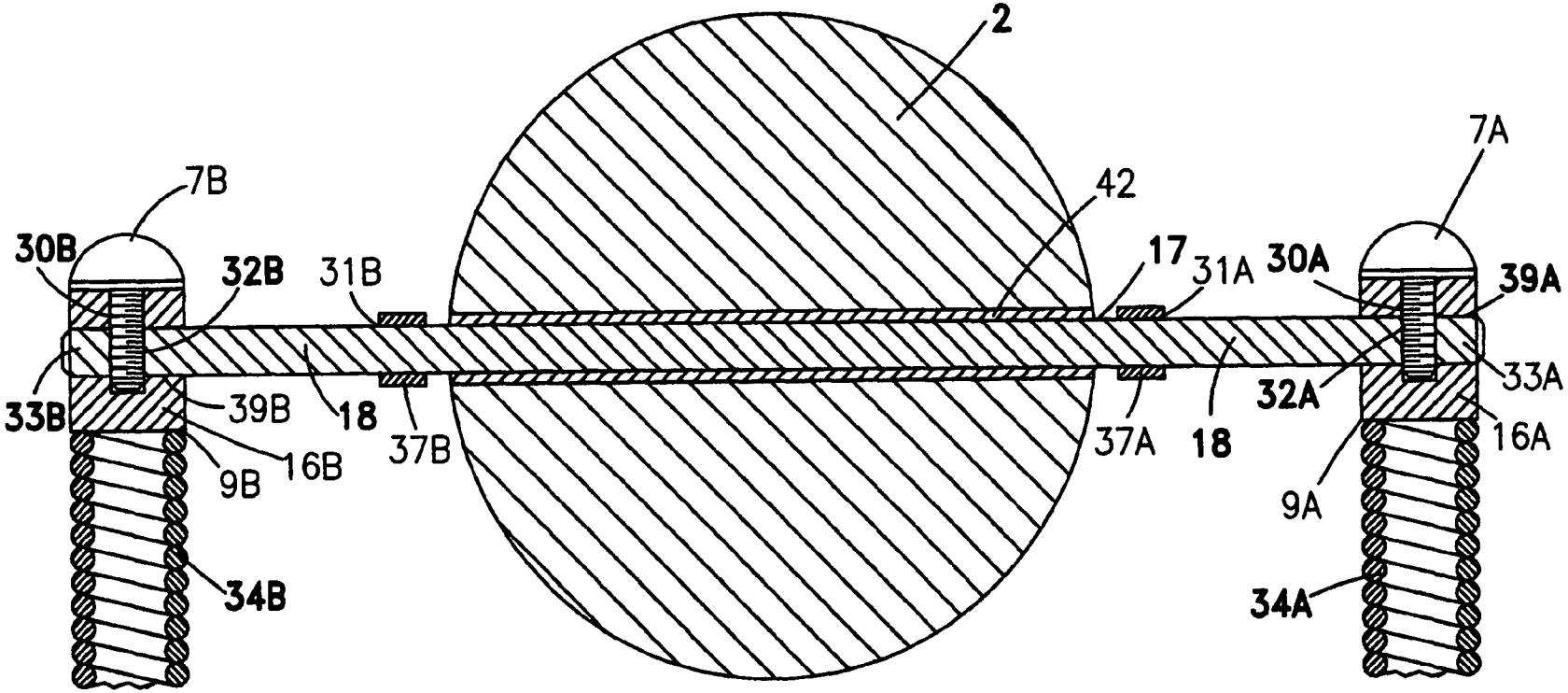
FIG. 6 is a cross-sectional view in the direction of 4-4 of FIG. 2, with a ball and pair of stoppers attached to a rod, and each threaded opposing end of the rod is attached by a common threaded screw to each solid tip of pair of parallel straight arms portions.
Figure 7A:
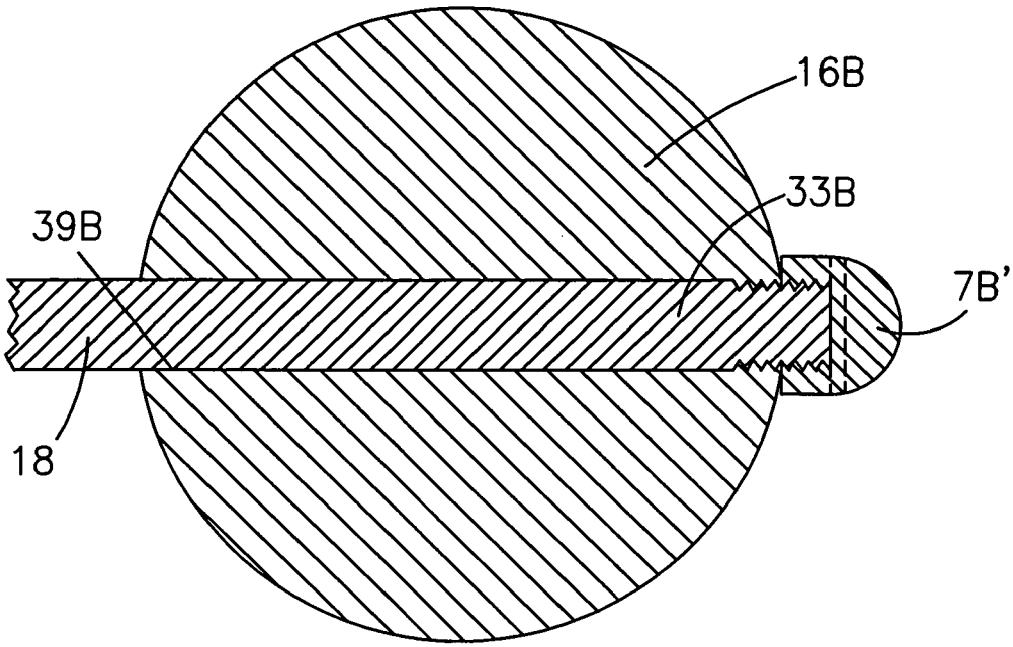
FIG. 7A is a left-sided top cross-sectional view of an alternate attachment of the threaded ends of the rod attached to the solid tips by a common threaded attachment means, such as a threaded screw cap.
Figure 7B:
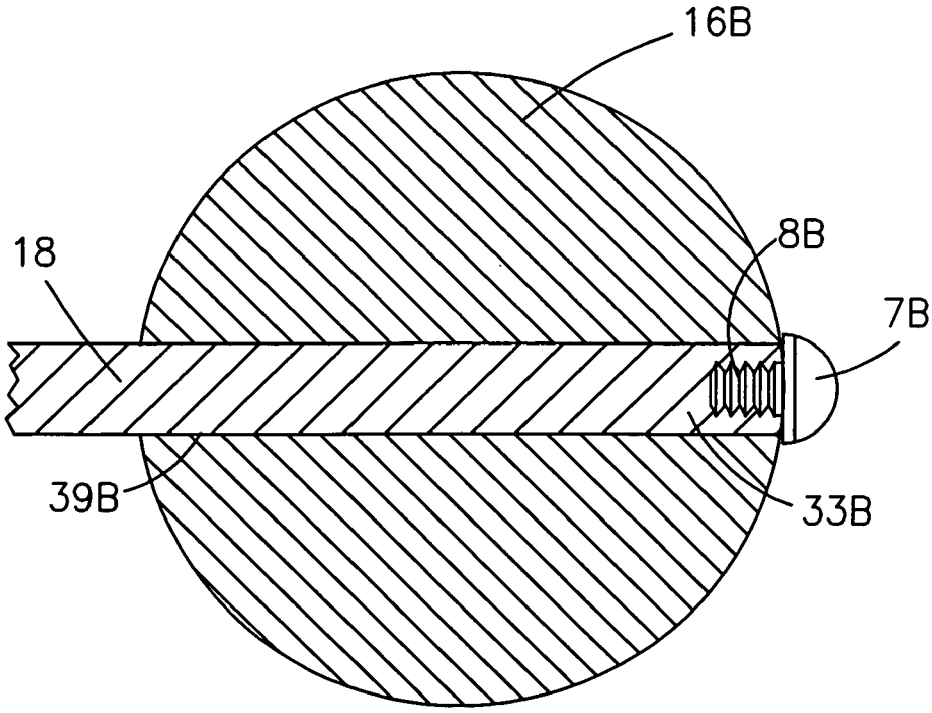
FIG. 7B is a left-sided top cross-sectional view of an alternate attachment of the threaded ends of the rod attached to the solid tips by a common threaded attachment means, such as a threaded screw.

Referencing FIGS. 1-7B', the following detailed description of the invention describes its structure and method of use. Device 1 is an invention for training pitching techniques and improving muscle strength. A ball 2 is attached to a filament like attachment means, which can either be an elastic string (as shown in FIGS. 1-5), or a rod (as shown in FIGS. 6, 7A-7B').

Figure 2:
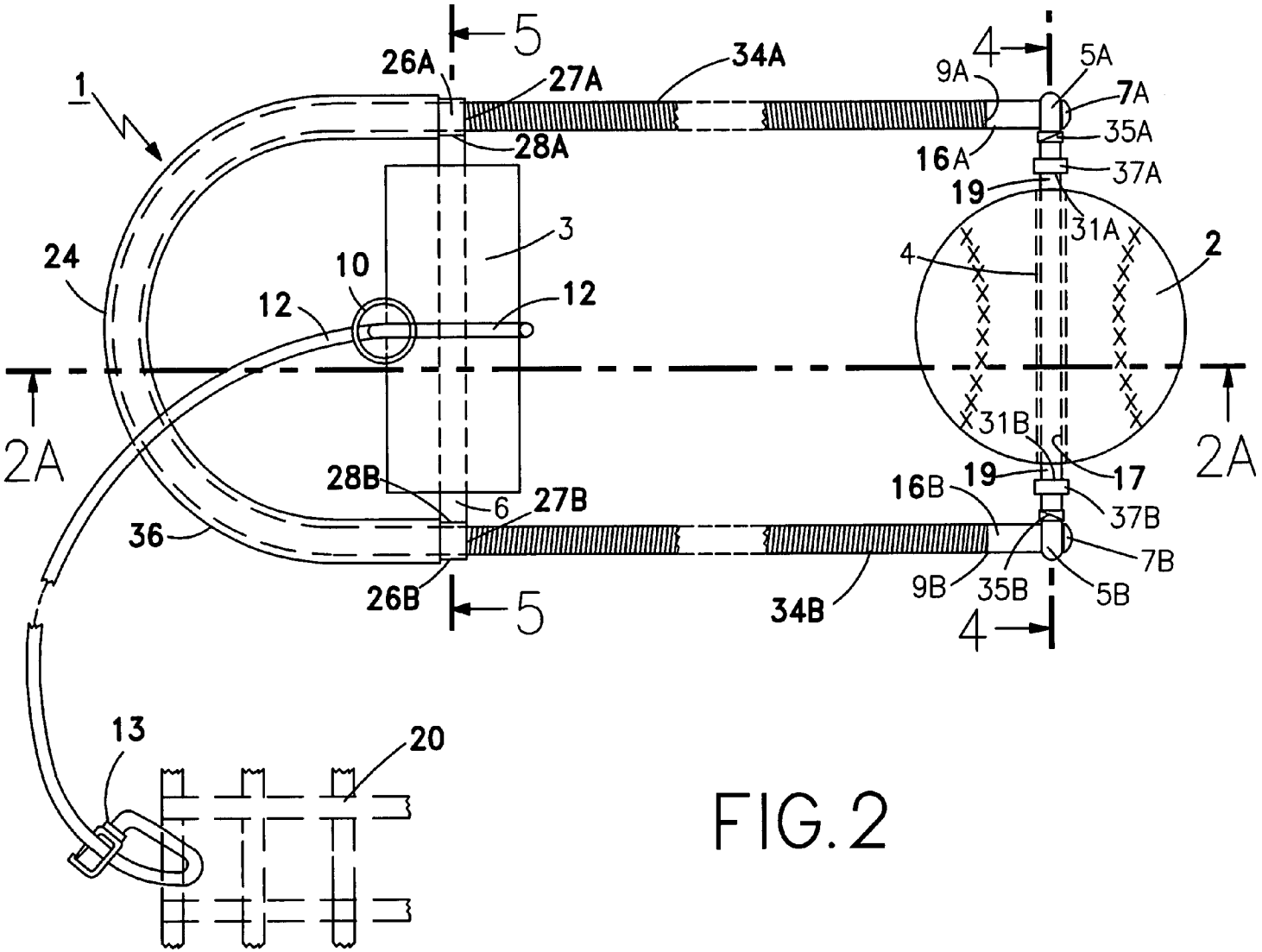
FIG. 2 is a top planar view of the present invention, with a ball (with an internal polar tunnel with sleeve shown in phantom) attached to an elastic string, and opposing looped ends of the elastic string are attached to the solid tips of the device by common threaded attachment means, such as screws, with an elastic band for resistance training attached to the device's strap and to a fence by common anchoring means.

As shown in detail in FIG. 2, device 1 is an elongated U shaped structure consisting of a coiled tubular pair of parallel straight shaft portions 34A and 34B, with pair of solid tips 16A and 16B, respectively, and a coiled tubular curved end portion 24. Parallel straight shaft portions 34A and 34B, solid tips 16A and 16B, and curved end portion 24 are preferably made of metal.

Figure 2A:
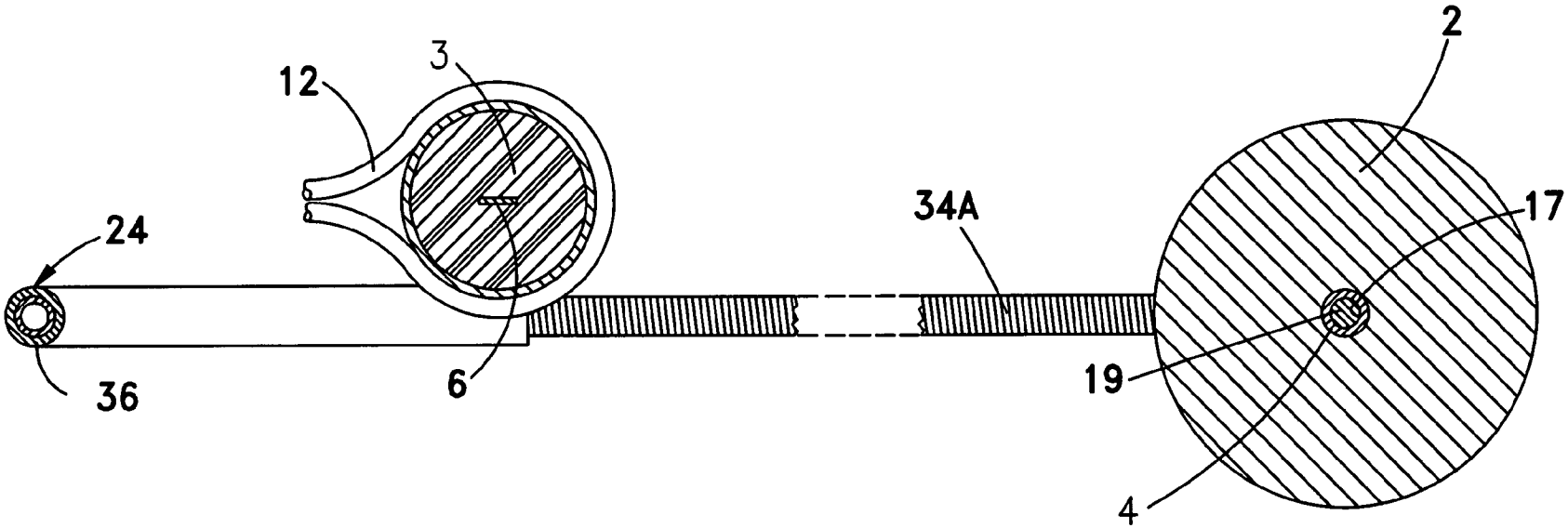
FIG. 2A is a broken cross-sectional view in the direction of 2A-2A of FIG. 2, which shows an elastic string inside the sleeve in the ball's polar tunnel, parallel straight shaft portion, curved end portion covered with a casing, and padded strap with elastic band for resistance training wrapped around it.

As shown in FIGS. 1, 2, and 2A, casing 36, covers curved end portion 24 to ensure a comfortable fit. As shown in FIGS. 1 and 2, solid tips 16A and 16B are fused to pair of parallel straight shaft portions 34A and 34B, along juncture of planar surface 9A and 9B, respectively.

The device 1 is flexible enough to give during play, but offers sufficient resistance to return to its original shape after use. The tubular coiled structure of the pair of parallel straight shaft portions 34A and 34B and curved end portion 24 make the device 1 as lightweight as possible without sacrificing strength. Tension and resistance accommodate the age and gender of the user.

Devices of various sizes can accommodate children and adults. As shown in FIG. 1, device 1 is attached to pitching forearm 22 by sliding pitching forearm 22 under strap 6 which forms a reverse sling (as shown FIG. 5), in order for strap 6 to sit comfortably on top of pitching forearm 22. Thus, as shown in FIG. 1, device 1 is held in place by the tension created between strap 6 and pitching forearm 22.

For athletic equipment, proper fit is tantamount to maximum effectiveness. As shown in FIG. 1, in order to insure proper fit of device 1, user 21 puts on device 1 with ball 2 attached, by aligning curved end portion 24 adjacent to elbow 23. To aid in comfort, curved end portion 24 is covered with a casing 36 of spongy material (such as neoprene). Once so aligned, the position of pair of solid tips 16A and 16B are adjusted so that ball 2 can be gripped by fingers 11.

As shown in FIGS. 1, 2, 2A and 5, to aid in comfort, strap 6 is covered with a spongy tubular casing 3 (such as neoprene). Strap 6 is preferably slidably attached to pair of parallel straight shaft portions 34A and 34A, through a pair of parallel sleeves 27A and 27B, respectively. As shown in detail in FIG. 5, parallel sleeves 27A and 27B are formed by a looping opposing ends 26A and 26B of strap 6 and stitching opposing ends 26A and 26B together along line of parallel longitudinal stitches 28A and 28B, respectively.

As shown in FIG. 1, strap 6 can be slipped along pair of parallel straight shaft portion 34A and 34B to adjust to a comfortable position on pitching forearm 22. Strap 6 covered with tubular casing 3 is also shown in cross-sectional view in FIG. 2A.

Alternatively, strap's 6 opposing ends 26A and 26B may be either sewn into or glued onto the inside of the parallel straight shaft portions 34 A and 34B along a line parallel to the longitudinal axis of the parallel straight shaft portions 34A and 34B.

FIGS. 1, 2, 3, 3A and 4 show the preferred method of attaching ball 2, to elastic string 19. Elastic string 19 is attached to solid tips 16A and 16A of pair of parallel straight shaft portions 34A and 34B by common threaded male attachment means (screws) 7A and 7B, respectively. As further shown in FIGS. 1, 2, and 4, elastic string 19 is fitted through non threaded bores 31A and 31B which are parallel to and equal in dimension to the latitudinal axis of stoppers 37A and 37B. Polar tunnel 17 is lined with sleeve 4, which is preferably made of metal or plastic. The diameter of elastic string 19 approximately equals to the diameter of sleeve 4 in tunnel 17 of ball 2, and the diameter of central non threaded bores 31A and 31B of stopper 37A and 37B, respectively, to ensure a tight fit of elastic string 19.

Figure 3A:
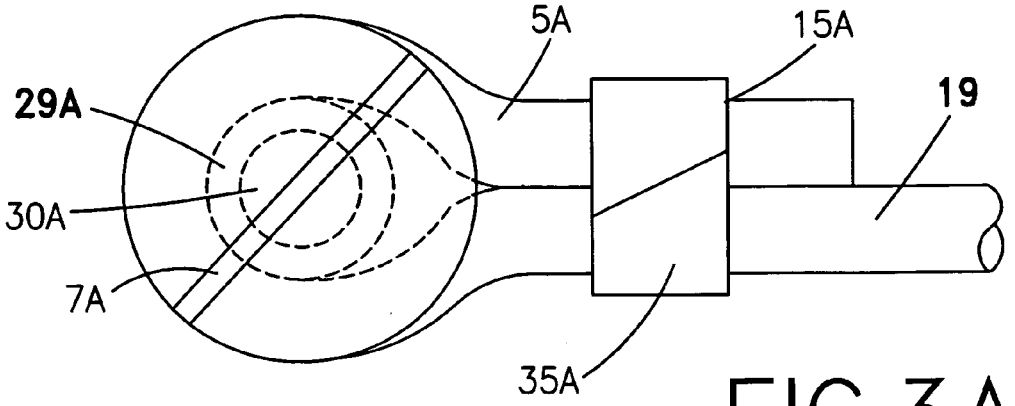
FIG. 3A is a top view of the device as shown in FIG. 3.
Figure 3:
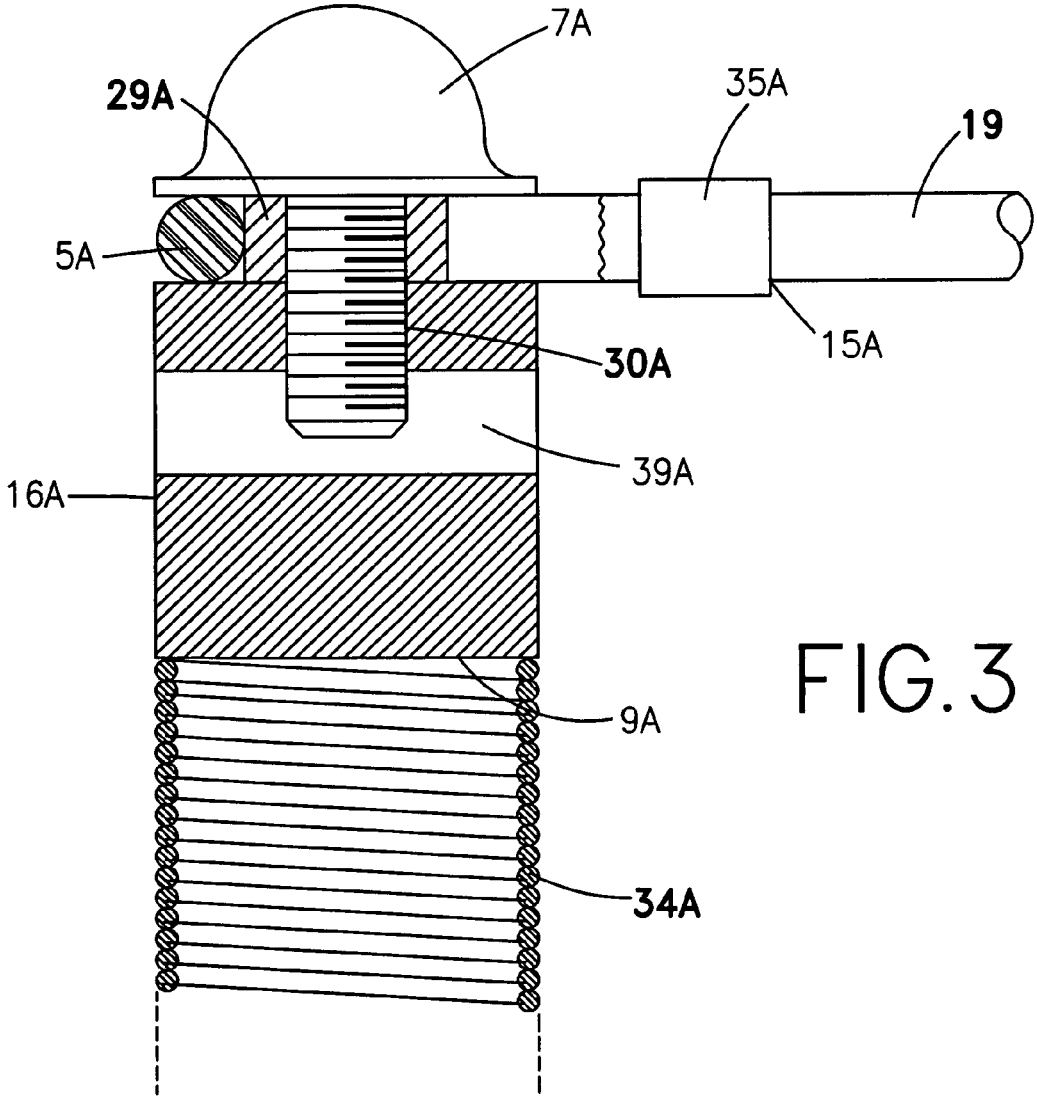
FIG. 3 is an enlarged broken out sectional view, showing one of the lined looped opposing ends of the elastic string formed by a pinch clamp and attached to one of the solid tips by a common threaded attachment means, such as a wing tipped screw, which is slipped through the lined looped opposing end and then threaded through a central threaded bore in the solid tip, also shown is the juncture of solid tips and parallel straight shaft portions.
Figure 4:
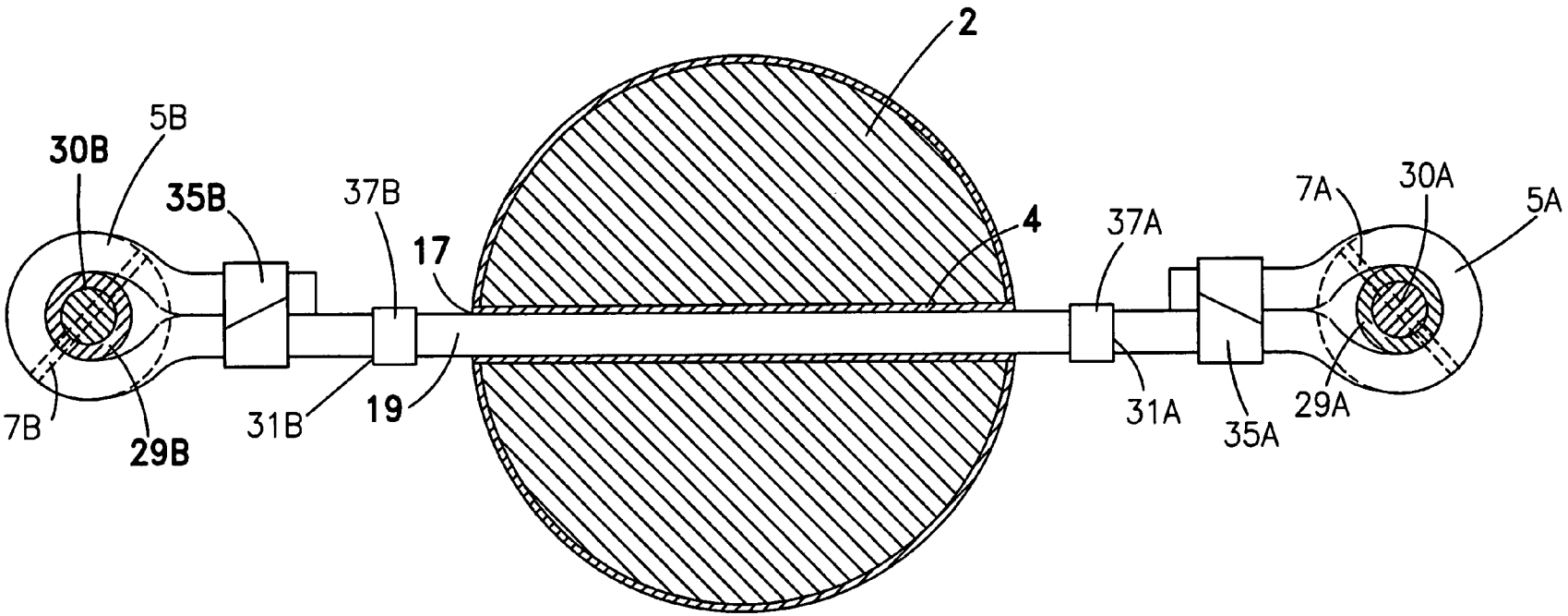
FIG. 4 is a cross-sectional view in the direction of 4-4 of FIG. 2, with a ball with an internal polar tunnel with a sleeve, and a pair of stoppers attached to an elastic string, and each of the lined looped opposing ends of the elastic string is threadedly attached by a common threaded screw to each of the solid tips of the pair of parallel straight arm portions.
Figure 5:
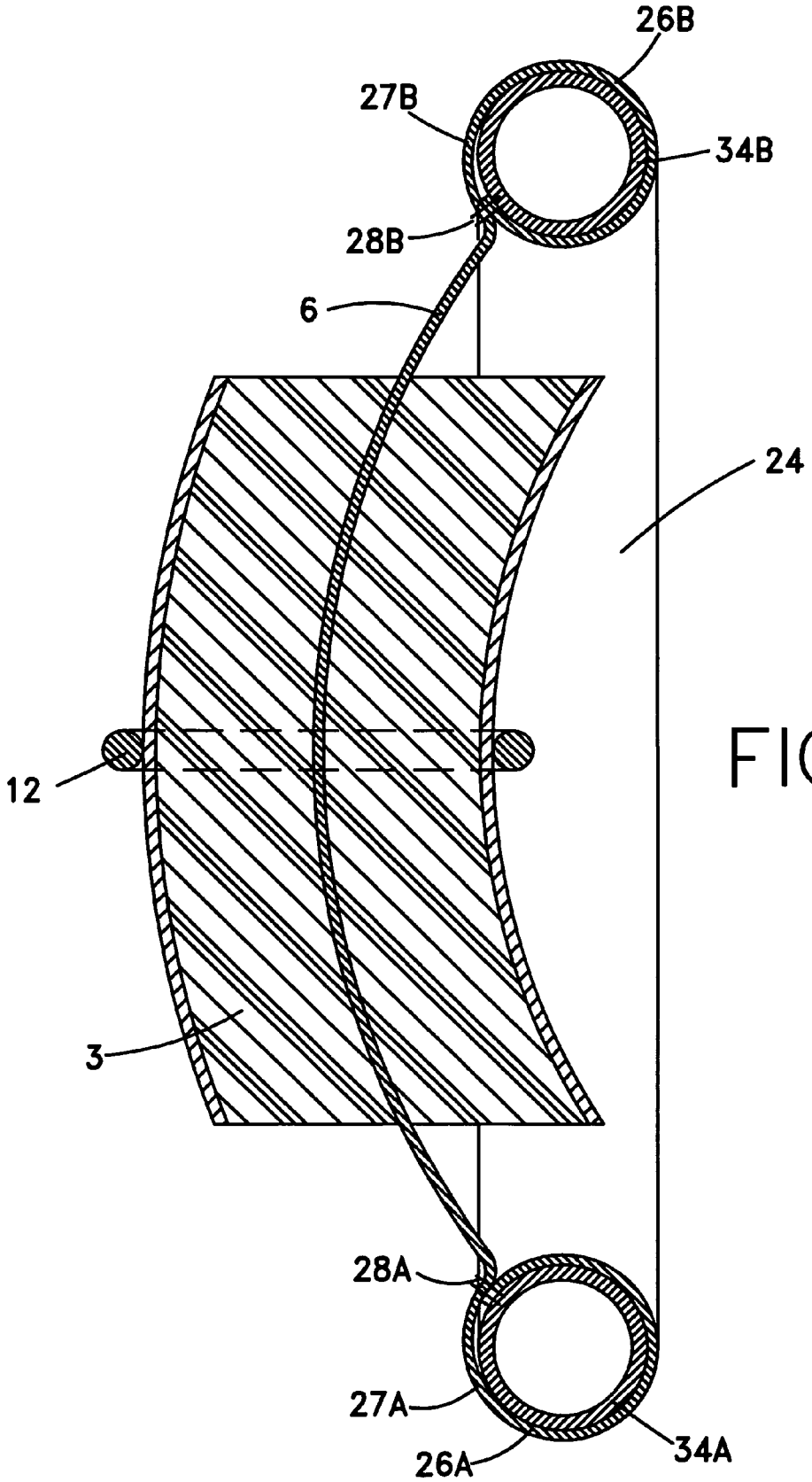
FIG. 5 is a cross-sectional view in the direction of 5-5 of FIG. 2, showing a strap forming a reverse sling covered with a padded casing, opposing ends of the strap stitched along a line of longitudinal stitches forming sleeves through which the parallel straight shaft portions are fitted, elastic band wrapped around the padded strap for resistance training, and padded curved end portion of the device.

As shown in detail in FIGS. 3 and 3A, common threaded male attachment means 7A and 7B (7A is shown) is simultaneously threaded through loops 5A and 5B (5A is shown) of elastic string 19, reinforced with liners 29A and 29B, (29A is shown), as well as through pair of threaded central bores 30A and 30B (30A is shown) in solid tips 16A and 16B (16A is shown), in order to attach string 19 to device 1. Liners 29A and 29B are preferably made of metal or plastic. Central threaded bores 30A and 30B are aligned parallel to the longitudinal axis of solid tips 16A and 16B, respectively. Looped opposing ends 5A and 5B (5A is shown) are formed by looping opposing ends of elastic string 19 and securing to sleeves 15A and 15B (15A is shown), of common pinch clamp means 35A and 35B, (35A is shown) respectively.

As illustrated in FIG. 1, when elastic string 19 is threaded through ball 2, at the moment when ball 2 is released from the grip of fingers 11, ball 2 bounces in all directions along string 19, following the flexible movements of wrist 14 which indicates the speed and torque (spin) placed upon ball 2, to simulate pitching. As shown in FIGS. 1 and 2, Stoppers 37A and 37B limit lateral movement of ball 2.

As shown in FIGS. 6, 7A-7B', rod 18 can be substituted for elastic string 19. FIG. 6 shows the preferred embodiment, with rod 18 attached to solid tips 16A and 16B. Opposing ends 33A and 33B of rod 18 have threaded bores 32A and 32B, respectively, which are offset from the end of rod 18 and aligned parallel to and equal in measurement to the latitudinal axis of rod 18. Pairs of solid tips 16A and 16B contain two bores, non threaded bores 39A and 39B, (which are offset from the ends of solid tips 31A and 31B, and aligned parallel to and equal in measurement to the latitudinal axis of solid tips 16A and 16B), and threaded central bores 30A and 30B, (which are aligned parallel to the longitudinal axis of solid tips 16A and 16B), respectively.

As further shown in FIG. 6, by slipping rod 18 through non threaded bores 39A and 39B, and aligning threaded central bores 30A and 30B, with the threaded bores 32A and 32B, threaded male screws 7A and 7B can be simultaneously screwed through both sets of bores 30A and 32A, and 30B and 32B, respectively, in order to threadedly attach rod 18 to the device 1.

In an alternative embodiment, as shown in FIGS. 7A and 7A', rod 18 is threaded through bores 39A and 39B (39A is shown in FIG. 7A and 39B is shown in FIG. 7A') in tips 16A and 16B (16A is shown in FIG. 7A and 16B is shown in FIG. 7A'). Common threaded attachment means 7A' and 7B', (7A' is shown in FIG. 7A and 7B' is shown in FIG. 7A'), (such as threaded female screw caps) are threadedly attached to threaded male opposing ends 33A and 33B (33A is shown in FIG. 7A and 33B is shown in FIG. 7A') of rod 18, to anchor rod 18 to device 1.

Another alternative method to threadedly attach rod 18 to device 1 is shown in FIGS. 7B and 7B'. Common threaded male screw attachment means 7A and 7B (7A is shown in FIGS. 7B and 7B is shown in FIG. 7B'), are threadedly attached to central threaded bores 8A and 8B (8A is shown in FIG. 7B and 8B is shown in FIG. 7B') of rod 18, which are aligned parallel to the longitudinal axis of rod 18 in opposing ends 33A and 33B (33A is shown in FIG. 7B and 33B is shown in FIG. 7B'), to anchor rod 18 to the device 1.

As shown in all embodiments of the invention, in FIGS. 1, 2, 3, 3A, 4, 6, 7A, 7A', 7B and 7B', whether elastic string 19 or rod 18 is used, in order not to scratch or cause other harm the user, the outside surface of screws 7A and 7B, or screw caps 7A' and 7B' are smooth.

As shown in FIGS. 1 and 2, once device 1 with ball 2 attached, is strapped to pitching forearm 22, and anchored to stable object 20, such as a fence, (shown in partial view), user 21 can learn and practice proper technique for different pitches, as well as strengthen muscles. Shown in FIGS. 1, 2, 2A and 5, elastic band 12 is looped around and attached to strap 6 by common anchoring means 10, such as a loop ring, and also attached to stable object 20 such as a fence, by common anchoring means 13, such as a clasp.

Alternatively, elastic band 12 may be attached to curved end portion 24, rather than to strap 6. The elasticity of elastic band 12 matches the user's strength, age and gender.

At the beginning of the pitch, when pitching forearm 22 is swung behind user 21, and the rest of user's 21 body is simultaneously aligned to set up the pitch, elastic band 12 is collapsed and offers no resistance. When the pitch is followed through, and pitching forearm 22 is fully extended and swung in front of user 21, and the rest of user's 21 body is simultaneously aligned with pitching forearm 22, elastic band 12 will be stretched to its maximum capacity and creates a resistance force against user's 21 muscles which increases muscle strength.

Preferable dimensions of the parts of device 1 are as follows. The length of device 1 ranges between 10 to 20 inches, to fit both children and adults. The diameter of pair parallel straight shaft portions 34A and 34B, curved end portion 24 and pair of solid tips 16A and 16B, ranges between one half inch to one inch. The diameter of elastic string 19 or rod 18 ranges between one eighth to one quarter inch in diameter. The length of elastic string 19 or rod 18 ranges between six to eight inches. The measurement of pair of stoppers 37A and 37B latitudinal axis ranges between one quarter to one half inches. The thickness of casing 3 covering strap 6 and the casing 36 covering curved end portion 24 ranges between one half to one inch. The length and width of strap 6 ranges between six to eight inches in length and one half to one in width, respectively. The length of elastic band 12 used for resistance training ranges between 4 and 8 feet.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and the scope of the appended claims. The scope is to be accorded the broadest interpretation so as to encompass all such modifications and equivalent structures as is permitted by law.

REFERENCE NUMBERS IN THE DRAWINGS

| | |
|---|---|
| 1. | device |
| 2. | ball |
| 3. | casing covering strap |
| 4. | sleeve of polar tunnel |
| 5A and 5A. | Pair of looped opposing ends of elastic string |
| 6. | strap |
| 7A and 7B. | common threaded male attachment means |
| 7A' and 7B'. | common female threaded attachment means |
| 8A and 8B. | pair of central threaded bores at opposing ends of rod aligned parallel to the longitudinal axis of rod |
| 9A and 9B. | planar juncture |
| 10. | common anchoring means to attach elastic band to strap |
| 11. | fingers |
| 12. | elastic band |
| 13. | common anchoring means to attach elastic band to stable object |
| 14. | wrist |
| 15A and 15B. | sleeves in pair of pinch clamps |
| 16A and 16B. | pair of solid tips |
| 17. | polar tunnel of sphere |
| 18. | rod |
| 19. | elastic string |
| 20. | stable object |
| 21. | user |
| 22. | forearm |
| 23. | elbow |
| 24. | curved end portion |
| 25. | hand |
| 26A and 26B. | opposing ends of strap |
| 27A and 27B. | pair of sleeves of strap |
| 28A and 28B. | pair of parallel lines of longitudinal stitches forming sleeves |
| 29A and 29B. | pair of liners |
| 30A and 30B. | central threaded bores in pair of solid tips parallel to the longitudinal axis of pair of solid tips |
| 31A and 31B. | central non-threaded bores in pair of stoppers |
| 32A and 32B. | threaded bores offset from opposing ends of rod parallel to and equal in measurement to the latitudinal axis of rod |
| 33A and 33B. | opposing ends of rod |
| 34A and 34B. | pair of parallel straight shaft portions |
| 35A and 35B. | pinch clamp |
| 36. | casing covering curved end portion |
| 37A and 37B. | pair of stoppers |
| 38. | pitching arm |
| 39A and 39B. | non threaded bores offset from ends of pair of solid tips aligned parallel to and equal in measurement to the latitudinal axis of solid tips |

I claim:

1. A method for teaching pitching, for use in ball games, employing an apparatus attached to the forearm of a pitching arm of a user, comprising an elongated U shaped coiled tubular structure, which flexes during use and returns to its original shape when not in use, comprising a curved end portion aligned adjacent to the elbow of said pitching arm;

a pair of parallel straight shaft portions with a pair of solid tips wherein each solid tip is fused onto an end of a parallel straight shaft portion of said pair of parallel straight shaft portions, aligned on opposing sides of said forearm parallel to the longitudinal axis of said forearm, and running in length up to the hand of said user; a sphere with a polar tunnel which accepts a filament like anchoring means with opposing ends, and each opposing end of said opposing ends of said filament like anchoring means are attached by common attachment means to a solid tip of said pair of solid tips; a strap with opposing ends, wherein each opposing end of said strap is attached to said end of a parallel straight shaft portion of said pair of parallel straight shaft portion, which forms a reverse sling which rests on the upper surface of said forearm to support said device, and said sphere is aligned within the grip of the fingers of said pitching arm; comprising the following steps:

(a) gripping said sphere with said fingers;

(b) simultaneously swinging said pitching arm behind said user, while aligning plurality of body parts required for pitching (c) simultaneously swinging said pitching arm in front of said user, to fully extend and straighten said pitching arm, while aligning plurality of body parts required for pitching (d) simultaneously releasing said sphere from said grip of said fingers; and (e) observing the speed of spin and plurality of directions of movement of said sphere as far as said filament like anchoring means will allow, while being anchored to said filament like anchoring means;

whereby the act of pitching is simulated.

2. A method as in claim 1, wherein said polar tunnel is lined with a sleeve.

3. A method as in claim 1, wherein said filament like anchoring means is a rod, which is fixably attached to a pair of stoppers, with each of said stoppers having a central non threaded bore aligned parallel to and equal in measurement to the latitudinal axis of each of said stoppers, which accepts said rod, and each of said stoppers is adjacent to an opposing end of said polar tunnel of said sphere, whereby said sphere simultaneously spins around and moves laterally from side to side along said rod and abuts against said pair of stoppers which limit said lateral movement of said sphere.

4. A method as in claim 1, wherein said filament like anchoring means is an elastic string, which is fixably attached to a pair of stoppers, with each of said stoppers having a central non threaded bore aligned parallel to and equal in measurement to the latitudinal axis of each of said stoppers, which accept said elastic string, and each of said stoppers is adjacent to an opposing end of said polar tunnel of said sphere, whereby said sphere bounces in all directions on said elastic string, and is retrievable, while said pair of stoppers limit lateral movement of said sphere.

5. A method as in claim 1, wherein said curved end portion is covered with a tubular casing of shock absorbent material to increase comfort.

6. A method as in claim 1, wherein said reverse sling of said strap is covered with a tubular casing of shock absorbent material to increase comfort.

7. A method as in claim 1, further comprising a common elastic band with opposing ends, wherein one of said opposing ends is attached to said strap by a common anchoring means, such as a slip loop, and the other said opposing end is anchored to a stable object, such as a fence, by common anchoring means, such as a clasp, whereby said user can perform resistance training, by simultaneously swinging said pitching arm in front of said user, to extend and straighten said pitching arm to create maximum resistance on said elastic band.

8. A method as in claim 1, wherein said filament like anchoring means comprises an elastic string with opposing ends forming a pair of loops lined with sleeves, and a common means for securing said opposing ends together, such as a pinch clamp with a sleeve, is fixably attached to the base of each of said pair of loops and said sleeve accepts said opposing ends of said elastic string, and said pair of solid tips comprise central threaded bores aligned parallel to the longitudinal axis of said solid tips, whereby of said pair of loops and said central bores are aligned in order to be receive a common threaded attachment means, such as a threaded screw, to threadedly attached said elastic string to said device.

9. A method as in claim 1, wherein said filament like anchoring means comprises a rod, and said pair of solid tips comprise a non threaded bore aligned offset from the ends of said solid tips and parallel to and equal in measurement to the latitudinal axis of said pair of solid tips, through which each of said opposing ends of said rod is slipped through, and opposing ends of said rod comprise a threaded structure, which threadedly attach to common threaded attachment means, in order to attach said rod to said pair of solid tips.

10. A method as in claim 1, wherein said filament like anchoring means comprises a rod, and said pair of solid tips comprise a non threaded bore aligned offset from the ends of said pair of solid tips and parallel to and equal in measurement to the latitudinal axis of said pair of solid tips, through which each of said opposing ends of said rod is slipped, and said pair of solid tips comprise central threaded bores aligned parallel to the longitudinal axis of said pair of solid tips, and opposing ends of said rod comprise a threaded bore aligned offset from the ends of said rod and parallel to and equal in measurement to the latitudinal axis of said rod, whereby said threaded bores of said pair of solid tips and said rod are aligned so as to threadedly accommodate a common threaded male attachment means, such as a threaded screw, in order to attach said rod to said device.

11. A method as in claim 1, wherein said strap further comprises a pair of sleeves on opposing ends, formed by a pair of longitudinal stitches parallel to the longitudinal axis of said parallel straight shaft portions, whereby said pair of parallel straight shaft portions are slipped into said pair of sleeves, in order to adjust the position of said strap along the length of said parallel straight shaft portions.

* * * * *